US005562108A

United States Patent [19]

Hardy et al.

[11] Patent Number: 5,562,108

[45] Date of Patent: Oct. 8, 1996

[54] TOBACCO RECONSTITUTION

[75] Inventors: Kevin J. Hardy, Montreal; James N. Sinclair, London, both of Canada

[73] Assignee: British-American Tobacco Company Limited, Middlesex, England

[21] Appl. No.: 502,244

[22] Filed: Jul. 13, 1995

[30] Foreign Application Priority Data

Jul. 23, 1994 [GB] United Kingdom ..... 9414889

[51] Int. Cl.[6] ..... A24B 15/18; A24B 15/00

[52] U.S. Cl. ..... 131/375; 131/369

[58] Field of Search ..... 131/375, 359, 131/369, 353, 355

[56] References Cited

U.S. PATENT DOCUMENTS 4,337,783 7/1982 Hooper et al. ..... 131/375

4,625,737 12/1986 Keritsis et al. .

4,823,817 4/1989 Luke ..... 131/375

*Primary Examiner*—Jennifer Bahr

*Attorney, Agent, or Firm*—Kane, Dalsimer, Sullivan, Kurucz, Levy, Eisele and Richard

[57] ABSTRACT

In a process of tobacco reconstitution by extrusion a mixture of tobacco, starch and binder, with the addition of water, is extruded as a web. The extrudate is drawn down, whereby the thickness of the web is reduced. A minor proportion of the binder, which may be carboxymethyl cellulose, is fed to the extruder barrel in aqueous solution. This has the effect of increasing the tensile strength of the web, so that the web can be drawn down to a greater degree.

11 Claims, No Drawings

TOBACCO RECONSTITUTION

The subject invention relates to tobacco reconstitution by extrusion.

Disclosures have been made in the patent literature of tobacco reconstitution processes in which particulate tobacco material and a binder are fed to an extruder, whereby there is extruded a reconstituted tobacco product.

SUMMARY OF THE INVENTION

Examples of patent publications providing such disclosures are: CA 951209; EP 113595; U.S. Pat. No. 3,098,492 and U.S. Pat. No. T911017; and GB 2 201 080. It is a teaching of the prior patent literature that suitable binders for use in tobacco reconstitution by extrusion processes include hydroxypropyl cellulose (HPC) and carboxymethyl cellulose (CMC) or sodium carboxymethyl cellulose (SCMC). There is also a teaching that in addition starch may be fed to the extruder. Furthermore, water and a humectant, glycerol for example, may be fed to the extruder.

It is also known from the prior patent literature for water to remain in the liquid phase in the extruder barrel, but to flash off to steam as the extrudate issues from the extruder die, the result being that the cross-sectional area of the extrudate becomes larger than the cross-sectional area of the orifice of the die and there thereby being imparted to the extrudate a cellular interior structure.

Conveniently, the die orifice is of slit form, whereby the reconstituted tobacco extruded product is of web form. The web form product can then be cut to provide filler size particles.

It is a teaching of GB 2 201 080 (the contents of which is incorporated herein by reference) that a web form extrudate is, while in a plastic state, subjected to draw down to reduce the thickness dimension of the extrudate.

SUMMARY OF THE INVENTION

A tobacco reconstitution process in which a mixture comprising particulate tobacco, starch and binder, with the addition of water, is extruded to provide a web form extrudate, under such extrusion conditions that the extrudate assumes a cross-section greater than that of the exit orifice of the extruder die, and in which said extrudate, in a plastic state, is drawn down so as to effect a reduction in the thickness dimension thereof is hereinafter referred to as a "process as defined". In carrying out the process as defined it is much to be preferred that the low density structure of the extrudate is preserved by ensuring that the exertion thereon of draw down tensile force should not involve the application of lateral crushing forces.

DETAILED DESCRIPTION OF THE INVENTION

The subject invention provides a process as defined, wherein binder is fed to said extruder in aqueous solution.

The aqueous binder solution is of a fully flowable liquid character. Suitably, the binder which is fed to the extruder in aqueous solution is CMC or SCMC.

The binder solution concentration should be low. Preferably, the solution concentration should not exceed about 10% wt/wt, and more preferably should not exceed about 6%. A suitable range of solution concentrations has been found to be 0.2% to 4.0% wt/wt.

Advantageously, the aqueous solution of binder is used to supply the whole, or substantially the whole, of the process water fed to the extruder.

Preferably, the binder fed to the extruder in aqueous solution represents only a proportion of the total binder fed to the extruder, and more preferably represents a minor proportion of the total binder.

In an example of the subject invention HPC binder represented about 4% of a dry mixture of tobacco, starch and binder fed to an extruder, whereas CMC binder, fed as a 1% wt/wt aqueous solution fed to the extruder, represented only 0.04% by weight of the final reconstituted tobacco product.

If in order to provide the aqueous solution CMC is dissolved in water at room temperature, the solution should be agitated in order that the CMC becomes fully activated. This process typically takes 15 to 30 minutes.

By use of the subject invention the reconstituted tobacco extrudate can be drawn down to a lesser thickness dimension, with little or no concomitant reduction in other physical performance characteristics. That is to say, the extrudate can be drawn down to a greater degree. This effect can be obtained with only a very small addition of binder from the aqueous solution being added to the final product.

Advantageously, starch is dispersed in the aqueous solution of binder fed to the extruder, in which case the binder in solution is preferably CMC or a salt thereof, SCMC, for example. The starch suspension can be maintained for many hours with minimal or no agitation being required.

A solution comprising dissolved CMC and dispersed starch displays thixotropic properties when the starch is present up to a level of about 30% wt/wt.

For preference, starch suspended in an aqueous solution of binder fed to the extruder is not acid modified starch.

The addition of starch to the aqueous solution of binder has the advantages that the degree of draw down which the reconstituted tobacco extrudate can withstand is further enhanced and the colour of the extrudate is lighter. Furthermore, the total amount of starch used, i.e. that suspended in the solution and that fed to the extruder other than in the solution, in a dry state for example, can be reduced. There are no losses in other physical performance parameters.

In use of the subject invention, a proportion of starch fed to the extruder other than in said solution may be acid modified starch. Advantages obtained by so doing are the provision of an extrudate better able to withstand draw down, and the possibility of feeding a lesser amount of starch (other than in said solution) to the extruder and feeding a lesser overall amount of starch to the extruder.

The remaining proportion of the starch is suitably a regular grade starch containing amylopectin.

The ratio of acid modified starch to regular grade starch may be in a range of 1:4 to 4:1. By way of example, a suitable starch mix is 60% regular and 40% acid modified (by weight).

It has been noted that when a proportion of acid modified starch is used the dough within the extruder is more fluid and that there is a reduction in the pressure within the extruder barrel, as compared with the operation of a control process in which no acid modified starch is used. The lower pressure is advantageous in that processing can be maintained up to a more advanced state of wear of the screw elements.

The degree of polymerisation of amylopectin in the acid modified starch may be, for example, about one third that in the regular grade starch.

The mixture in the extruder may comprise sodium bicarbonate and/or ammonium bicarbonate and/or carbonated water.

Preferably, the sodium bicarbonate and/or ammonium bicarbonate is present in a range of 0.5% to 4% of the dry weight of the tobacco.

Within the extruder the sodium bicarbonate and/or ammonium bicarbonate is decomposed, and thus carbon dioxide gas is formed, the $CO_2$ gas being released from the extrudate downstream of the die. It has been found that the formation and release of $CO_2$ gas gives rise to an extrudate which exhibits a finer cellular structure and an enhanced tensile strength. The increase in tensile strength may be, for example, 10% to 20%.

According to an example of carrying out the subject invention, a dry blend of 5 Kg acid modified starch with 2% sodium bicarbonate, was fed to the inlet hopper of a twin-screw extruder. An aqueous solution of CMC, at 0.3% wt/wt concentration level, with a 30% wt/wt suspension therein of regular starch was injected into the extruder barrel downstream of the inlet hopper. Also injected into the barrel downstream of the hopper was glycerine.

As to the web-form extrudate issued from the extruder die water in the in the extrudate flashed off to steam, whereby a cellular interior structure was imparted to the extrudate, this effect being enhanced by the release of $CO_2$ gas by virtue of the inclusion of the sodium bicarbonate in blend fed to the extruder. The extrudate was drawn down and cooled by being passed about two chilled rollers in the general manner as described in GB 2 201 080.

By use of the subject invention as per the just related example, the web-form extrudate after the drawing down step had a thickness of about 0.75 mm. This is to be compared with a thickness of typically about 1.3 mm for extrudate obtained from the process as defined if the subject invention is not utilised. When the subject invention is utilised, the tensile strength of the resultant extrudate exhibits an enhancement of 25%, for example.

We claim:

1. A tobacco reconstitution process, wherein a mixture comprising particulate tobacco, starch and binder, with the addition of water, is extruded to provide a web form extrudate, under such conditions that the extrudate assumes a cross-section greater than that of the exit orifice of the extruder die, said extrudate, in the plastic state thereof, being drawn down so as to effect a reduction in the thickness dimension thereof, and a minor proportion of the total binder being fed to the extruder in aqueous solution at a location of the extruder downstream from the feed to the extruder of the tobacco, starch and the major proportion of the binder, the concentration level of said solution not exceeding about 6% wt/wt.

2. The process as claimed in claim 1, wherein said binder in said aqueous solution is carboxymethyl cellulose.

3. A process as claimed in claim 1, wherein said binder in said aqueous solution is sodium carboxymethyl cellulose.

4. A process as claimed in claim 1, wherein said concentration level is in the range of 0.2% to 4% wt/wt.

5. A process as claimed in claim 1 wherein the water of said solution forms a major proportion of the total water fed to the extruder.

6. A process as claimed in claim 5, wherein the water of said solution supplies substantially the whole of the water fed to the extruder.

7. A process as claimed in claim 1 wherein a proportion of the total starch fed to the extruder is dispersed in said aqueous solution.

8. A process as claimed in claim 7 wherein a proportion of the starch fed to said extruder other than as dispersed in said aqueous solution is acid modified starch.

9. A process as claimed in claim 8, wherein said proportion of the starch is in the range of 20% to 80% wt/wt.

10. A process as claimed in claim 1 wherein the mixture in said extruder comprises sodium bicarbonate and/or ammonium bicarbonate.

11. A process as claimed in claim 1 wherein the mixture in said extruder comprises carbonated water.

* * * * *

UNITED STATES PATENT AND TRADEMARK OFFICE

CERTIFICATE OF CORRECTION

PATENT NO. : 5,562,108

DATED : October 8, 1996

INVENTOR(S) : Kevin J. Hardy and James N. Sinclair

It is certified that error appears in the above-indentified patent and that said Letters Patent is hereby corrected as shown below:

Col. 1, between lines 1 and 2; between lines 1 and 2 insert the headings

-- BACKGROUND OF THE INVENTION

Field of the Invention -- .

Col. 1, between lines 4 and 5; between lines 4 and 5 insert the heading

-- Brief Description of the Related Art -- .

Col. 1, line 10; delete "SUMMARY OF THE INVENTION" .

Signed and Sealed this

Seventeenth Day of December, 1996

*Attest:*

Bruce Lehman

BRUCE LEHMAN

*Attesting Officer*

*Commissioner of Patents and Trademarks*